US009073113B2

(12) United States Patent
Nishimoto

(10) Patent No.: US 9,073,113 B2
(45) Date of Patent: Jul. 7, 2015

(54) METHOD FOR SEAMING CAN COVER

(75) Inventor: Hideki Nishimoto, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 0 days.

(21) Appl. No.: 14/343,746

(22) PCT Filed: Apr. 27, 2012

(86) PCT No.: PCT/JP2012/061382

§ 371 (c)(1),
(2), (4) Date: Mar. 7, 2014

(87) PCT Pub. No.: WO2013/035378

PCT Pub. Date: Mar. 14, 2013

(65) Prior Publication Data

US 2014/0219748 A1 Aug. 7, 2014

(30) Foreign Application Priority Data

Sep. 8, 2011 (JP) ..... 2011-196557

(51) Int. Cl.

| | |
|---|---|
| ***B21D 51/30*** | (2006.01) |
| ***B21D 51/44*** | (2006.01) |
| ***B21D 51/26*** | (2006.01) |
| ***B21D 51/32*** | (2006.01) |

(52) U.S. Cl.

CPC ..... *B21D 51/30* (2013.01); *B21D 51/44* (2013.01); *B21D 51/2653* (2013.01); *B21D 51/32* (2013.01)

(58) Field of Classification Search

CPC ..... B21D 51/30; B21D 51/32; B21D 51/38; B21D 51/44; B21D 51/2653

USPC ..... 413/2, 4, 8, 27, 74

See application file for complete search history.

(56) References Cited

U.S. PATENT DOCUMENTS

| | | | |
|---|---|---|---|
| 5,113,636 A | 5/1992 | Mihara et al. | |
| 6,065,634 A | 5/2000 | Brifcani et al. | |
| 6,702,142 B2 * | 3/2004 | Neiner | 220/619 |

FOREIGN PATENT DOCUMENTS

| | | |
|---|---|---|
| JP | 01-245930 A | 10/1989 |
| JP | 08-229625 A | 9/1996 |

(Continued)

OTHER PUBLICATIONS

International Preliminary Report on Patentability of PCT/JP2012/061382 dated Mar. 12, 2014, form PCT/IB/373 and form PCT/ISA/237 (4 pages).

(Continued)

*Primary Examiner* — Teresa M Ekiert

(74) *Attorney, Agent, or Firm* — Westerman, Hattori, Daniels & Adrian, LLP

(57) ABSTRACT

This method for clinching a can cover has a small diameter center panel formed from a center panel, ring-shaped reinforcing groove, chuck wall, and curled part in which the ratio of the center panel diameter and can cover diameter is 0.65-0.75. The chuck wall is provided with a first inclined part and a second inclined part that are inclined toward the outside. When a flange tip part of a can body and the curled part of the can cover are superimposed in a virtual horizontal plane, a lower end part of the second inclined part or a second curved part that connects the first inclined part and second inclined part is positioned in a position in a range of an angle of 0°-35° to a virtual horizontal plane passing through the center of the curve of a rounded part of the flange.

5 Claims, 8 Drawing Sheets

(56) References Cited

FOREIGN PATENT DOCUMENTS

| | | | |
|---|---|---|---|
| JP | 11-505791 | A | 5/1999 |
| JP | 2006-122990 | A | 5/2006 |
| JP | 2010-215274 | A | 9/2010 |
| WO | 96/37414 | A1 | 11/1996 |

OTHER PUBLICATIONS

International Search Report, dated Jul. 31, 2012, issued in corresponding application No. PCT/JP2012/061382.

* cited by examiner

Fig. 6 Proir Art

METHOD FOR SEAMING CAN COVER

TECHNICAL FIELD

The present invention relates to a method for seaming a can cover on a can body, and particularly relates to a method for seaming a can cover requiring fewer materials in a pressure-resistant can cover used as a positive pressure can.

BACKGROUND ART

Conventionally, in a can cover for a positive pressure can of, e.g., beer or a carbonated beverage, there are proposed various lightweight pressure-resistant can covers each in which a pressure resistance is enhanced and reductions in material and the thickness of the material are achieved by reducing the center panel diameter of the can cover and changing the shape of a chuck wall (see Patent Documents 1 to 3).

As a typical example, in a can cover according to the invention of Patent Document 1, a can cover diameter d1/a panel diameter d5=1/0.717 is established, the center panel diameter is small as compared with that of the conventional pressure-resistant can cover, and the pressure tightness is enhanced by setting the inclination angle c of the chuck wall to about 43° which is extremely large correspondingly to the small center panel diameter. When the can cover of this type is seamed with a can body filled with a content, the can cover is supplied to the can body by a can cover transport turret and seamed therewith. However, as shown in FIG. 6 as Comparative Example described later, when the can cover is supplied to the can body, the chuck wall of the can cover is positioned close to the top of a flange of the can body, its eccentricity amount is large in a can cover shift section to the can body before an intake center p described later is reached, and the displacement of the center position tends to occur, and hence centering or attachment of the can cover to the can body is not properly performed, and an accident that double seaming is performed in a mismatch state in which the can cover is eccentric relative to the can body tends to occur.

That is, in the line of seaming the can cover with the can body, conventionally, a travel center line M of the can cover by a can cover supply turret intersects a travel center line $L_2$ of a can body transport conveyer and a travel center line N of a lifter plate (a knock-out pad of a seaming head is present on the same axis) at the intake center p on a line which joins the center of the can cover supply turret and the center of a seaming turret, as shown in FIG. 5. Accordingly, a can body c, a can cover e, and their respective center lines are set so as to substantially overlap each other in the can cover shift section to the can body (a region indicated by an angle $\alpha$ in FIG. 3), and the attachment of the can cover is performed at the intake center p. At this point, in the can cover shift section before the intake center p described above, there are cases where the can cover is supplied in an eccentric state in which the center position of the can cover is displaced with respect to the center position of the can body.

In the can cover proposed in Patent Document 1 in which the surface of the center panel is small and the inclination angle of the chuck wall is large, as shown in FIG. 6, the point of tangency between the chuck wall of the can cover and the flange of the can body is present on a substantially upper surface of the flange, and the displacement of the center position of the can cover with respect to the center position of the can body is conspicuously seen in the can cover shift section before the intake center p where the attachment of the can cover to the can body is performed. As a result, the displacement occurs, the eccentricity amount is increased, and the placement width of the top of the curled portion of the can cover which is placed on the flange of the can body is increased. When seaming is performed in a state where the top of the curled portion of the can cover is placed on the flange of the can body, as shown in FIG. 8, the curled portion of the can cover cannot be seamed with the flange of the can body normally, and a seam failure called a false seam in which a curled hook CH is crushed on a body hook BH tends to occur. As shown in the drawing, the false seam is hidden inside a seamed portion so that it is difficult to locate the false seam from the outside, and the occurrence of the false seam is a problem which should be avoided in terms of quality control.

Note that the detail of the cause of the increase in the eccentricity amount when the conventional lightweight pressure-resistant can cover proposed in Patent Document 1 is seamed is described later.

In addition, in each of can covers proposed in Patent Documents 2 and 3, the above-described problem is reduced, but a sufficiently satisfactory solution to the problem is not achieved yet.

Patent Document 1: Japanese Translation of PCT Application No. H11-505791

Patent Document 2: Japanese Patent Application Laid-open No. 2006-122990

Patent Document 3: Japanese Patent Application Laid-open No. 2010-215274

DISCLOSURE OF THE INVENTION

As described above, in the lightweight pressure-resistant can cover of this type having the small center panel diameter, since the eccentricity amount is increased when the displacement occurs, the lightweight pressure-resistant can cover has had a problem that, in order to prevent the occurrence of the seam failure such as the false seam or the like, it takes time to perform a precise adjustment in the guide of the can cover supply turret or the like, or a production speed is forced to be reduced so that productivity is impaired.

To cope with this, an object of the present invention is to provide a method for seaming the can cover capable of improving centering characteristics of the can body and the can cover, maintaining stable seaming characteristics without impairing productivity, and reducing the amount of use of a material by using the lightweight pressure-resistant can cover.

As the result of various studies for solving the above problem, the inventors have found that, by improving the shape of the can cover and setting the positional relationship between the can body and the can cover to a specific positional relationship therebetween, centering characteristics of the can body and the can cover are improved, and seaming can be performed without causing the seam failure and without impairing productivity, and have arrived at the present invention.

That is, a method for seaming a can cover of the present invention which solves the above problem is a method for seaming a can cover formed of a center panel, an annular reinforcing groove, a chuck wall, and a curled portion, with the center panel having a small-diameter satisfying a ratio between a center panel diameter and a can cover diameter of 0.65 to 0.75, this method being implemented such that the chuck wall includes a first inclined portion and a second inclined portion which are outwardly inclined, and a lower end portion of the second inclined portion or a second curved portion which connects the first inclined portion and the second inclined portion is positioned at a position in a range of an angle from 0° to 35° with respect to an imaginary horizontal plane passing through a curve center of an R portion of a flange when a top of the flange of a can body and a top of the curled portion of the can cover overlap one another on an imaginary horizontal plane.

In the method for seaming the can cover, a maximum value of an eccentricity amount between the can cover and the can body is preferably less than 0.8 mm.

In addition, an outer inclination angle θ1 of an outer wall of the annular reinforcing groove with respect to a vertical axis is preferably from 0° to 15°, an inclination angle θ2 of the first inclined portion of the chuck wall is preferably from 50° to 70°, an inclination angle θ3 of the second inclined portion is preferably from 0° to 20°, and a vertical height h1 from a lower end of the second inclined portion to a top surface of the curled portion is preferably from 2.5 mm to 4.5 mm.

Effects of the Invention

According to the method for seaming the can cover of the present invention, even in the lightweight pressure-resistant can cover having the small-diameter center panel, the eccentricity amount is reduced by reducing the displacement of the center position of the can cover with respect to the center position of the can body, centering is made possible by reducing the placement width of the top of the curled portion of the can cover which is placed on the flange of the can body, and it becomes possible to reduce the amount of use of the can cover material and cost while maintaining stable seaming characteristics without reducing the production speed.

EXPLANATION OF REFERENCE NUMERALS

Figure 1:
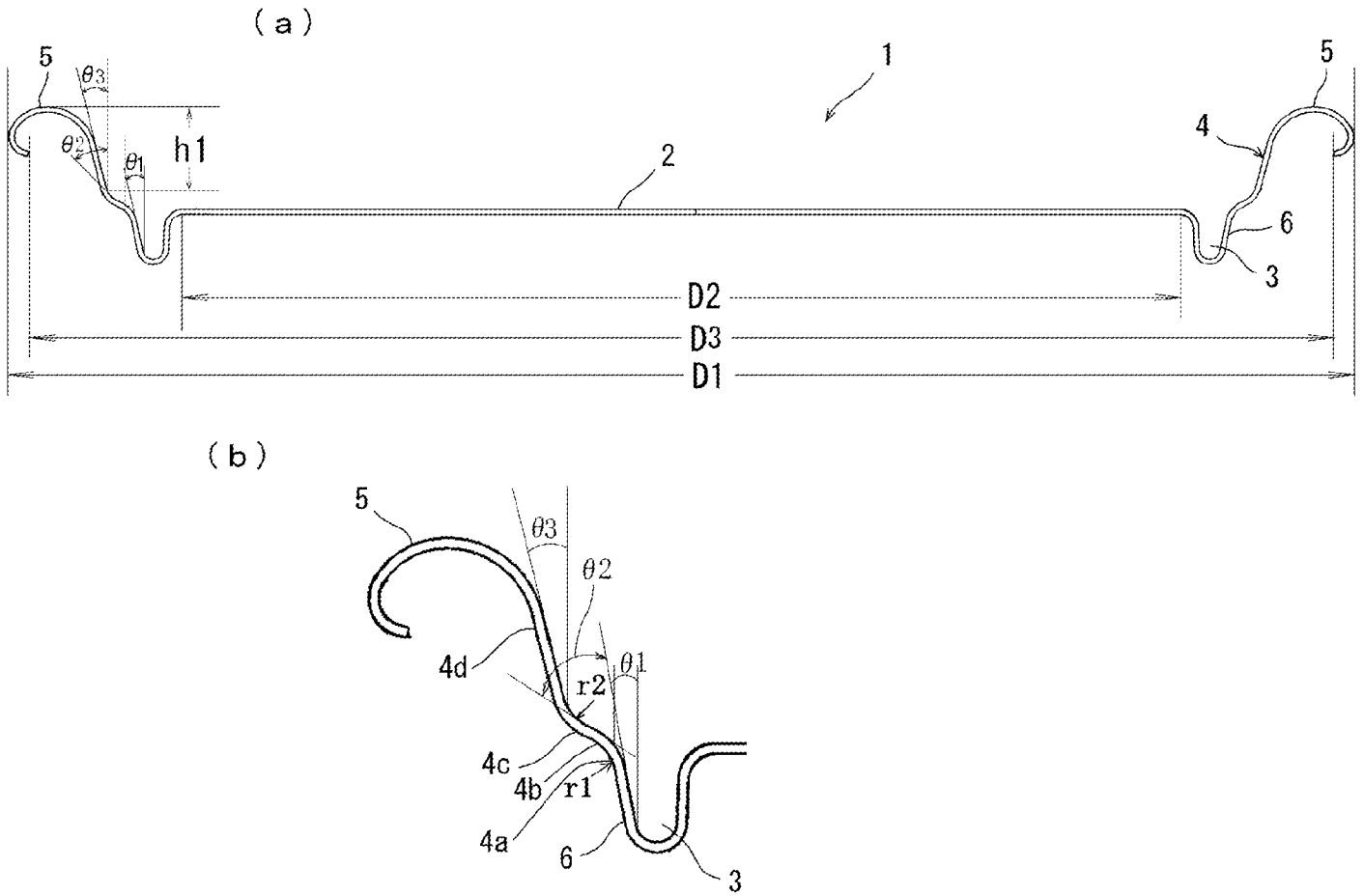
FIG. 1(*a*) is a cross-sectional view of a lightweight pressure-resistant can cover applied to the present invention, and FIG. 1(*b*) is an enlarged view of the principal portion thereof.

1 can cover
2 center panel
3 annular reinforcing groove
4 chuck wall
5 curled portion
6 outer wall
20 can cover supply turret
21 seaming turret
22 discharge turret
23 can body supply conveyor
25, 27 engaging concave portion
30 lifter
31 inner guide rail
32 outer guide rail
33 flange guide
50 lightweight pressure-resistant can cover of Comparative Example
70 can body
71 flange
72 R portion

BEST MODE FOR CARRYING OUT THE INVENTION

Before an embodiment of the present invention is described, the cause of an increase in eccentricity amount when the conventional lightweight pressure-resistant can cover proposed in Patent Document 1 is seamed is described with reference to FIGS. 3 to 5. Note that, in the following description, elements are the same as those of the embodiment of the present invention except the shape of the can cover.

Figure 3:
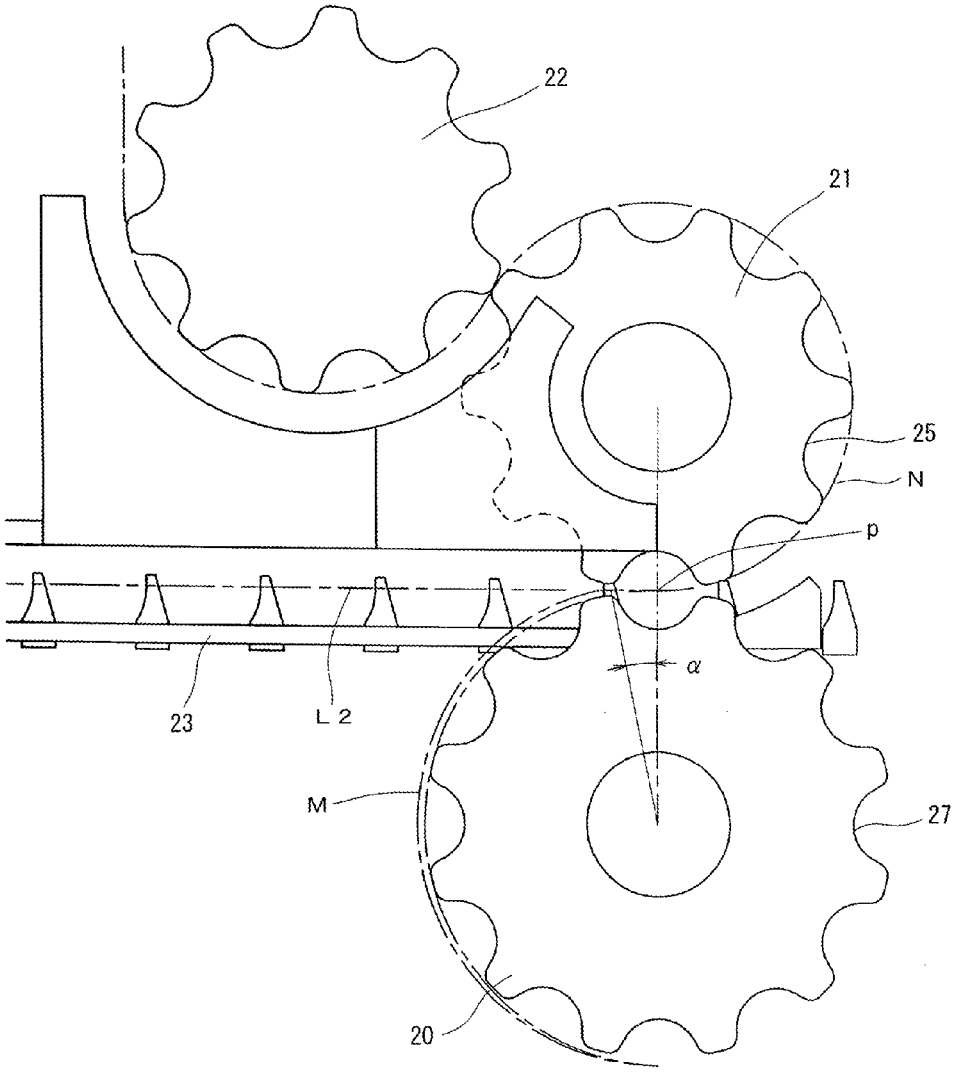
FIG. 3 is a view of the schematic arrangement of a supply device of the can cover and the can body.

FIG. 3 is a view of the schematic arrangement of a supply device of a can cover and a can body, and the supply device thereof has a can cover supply turret 20, a seaming turret 21, and a discharge turret 22 which are rotationally driven in synchronization with each other, and a can body supply conveyor 23 comprised of a pusher conveyor having a constant pitch. The can body filled with a content is transported by the can body supply conveyor 23, gradually engaged by an engaging concave portion 25 of the seaming turret 21 as the can body approaches an intake center p, and shifted to the seaming turret 21 from the position of the intake center p.

On the other hand, a can cover 50 is transported by being guided by an inner guide rail 31 and an outer guide rail 32 (see FIG. 4) disposed concentrically with the can cover supply turret 20 along the inner and outer peripheral portions of an engaging concave portion 27 of the can cover supply turret 20 and being pushed by a pusher provided in the can cover supply turret 20, a can body 70 which passes below the can cover 50 ascends at the terminal end portion of a can cover shift section to the can body 70, and the can cover 50 is lifted up from the guide rails at the intake center p and attached to a can body opening portion. At almost the same time, a knock-out pad (not shown) of a seaming head positioned in the upper portion of each engaging concave portion 25 of the seaming turret 21 descends, the can body 70 and the can cover 50 are shifted to the seaming turret 21 in a state where the can cover 50 is attached to the can body 70 at the point of time when the can body 70 and the can cover 50 pass the intake center p, and seaming is performed.

Figure 4:
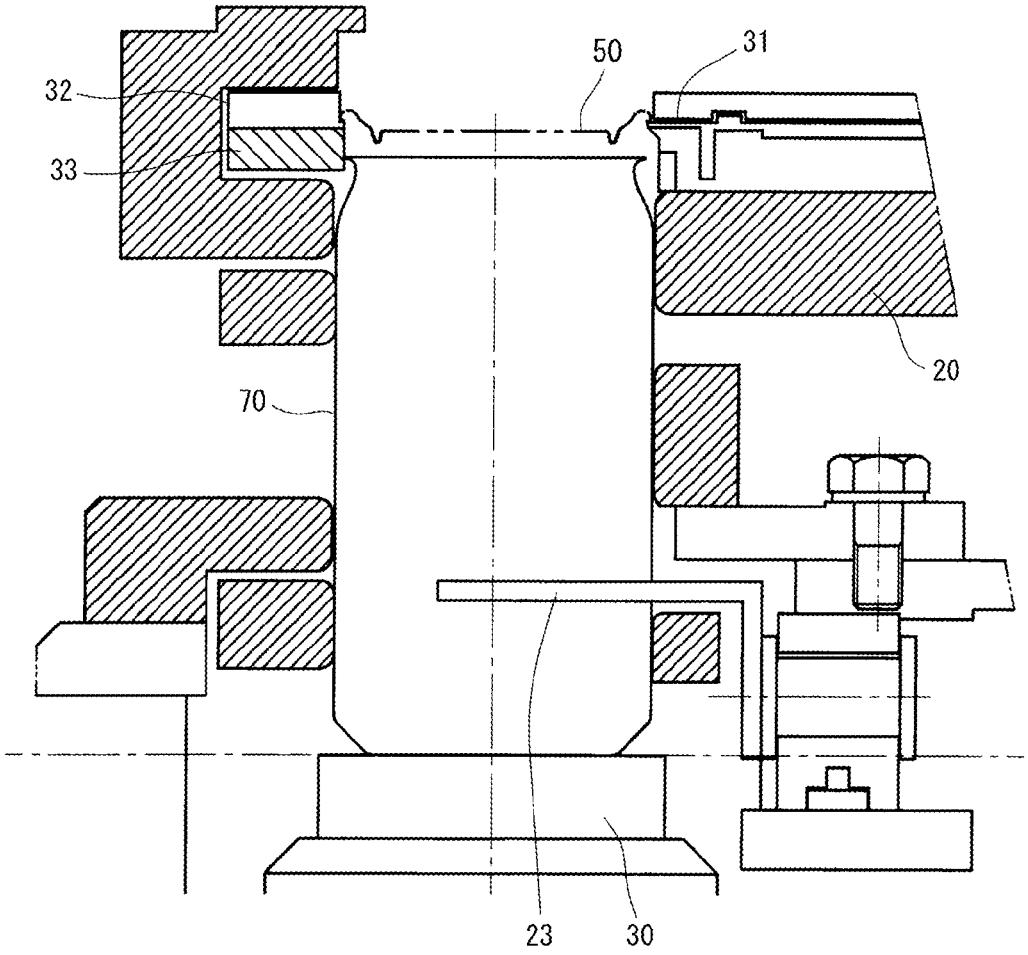
FIG. 4 is a cross-sectional view showing the states of the can cover and the can body before a can cover shift section.
Figure 5:
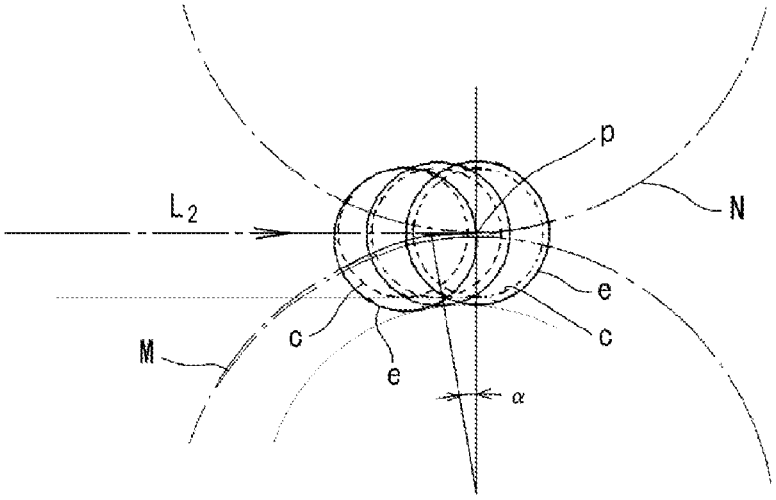
Fig. 5 Prior Art
FIG. 5 is a schematic view showing movement loci of the can body and the can cover until an intake center p is reached.

FIG. 4 is a cross-sectional view showing a state where the can body 70 before the can cover shift section is placed on a lifter plate 30 and the can cover 50 is about to be attached thereto. The inner guide rail 31 which receives the top of the curled portion of the can cover 50 is provided in the upper portion of the can cover supply turret 20, the outer guide rail 32 is provided beyond a concave portion which allows the rotation of the seaming turret 21 on the opposing seaming turret 21 side, and the transport path of the can cover 50 transported by the can cover supply turret 20 is thereby configured. In addition, in FIG. 4, 33 denotes a flange guide, and the flange guide is brought into contact with the flange of the can body 70 placed on the lifter plate 30 to perform centering of the can body 70 on the lifter plate 30. Further, similarly to the present embodiment described later, a travel center line M of the can cover 50 formed by the transport path is set to match a travel center line $L_2$ of the can body supply conveyor 23 substantially linearly in the range from the intake center p to the position at an intake angle α (the point of start of picking up of the can cover by the can body), and centering characteristics of the can cover 50 are thereby enhanced.

Figure 6:
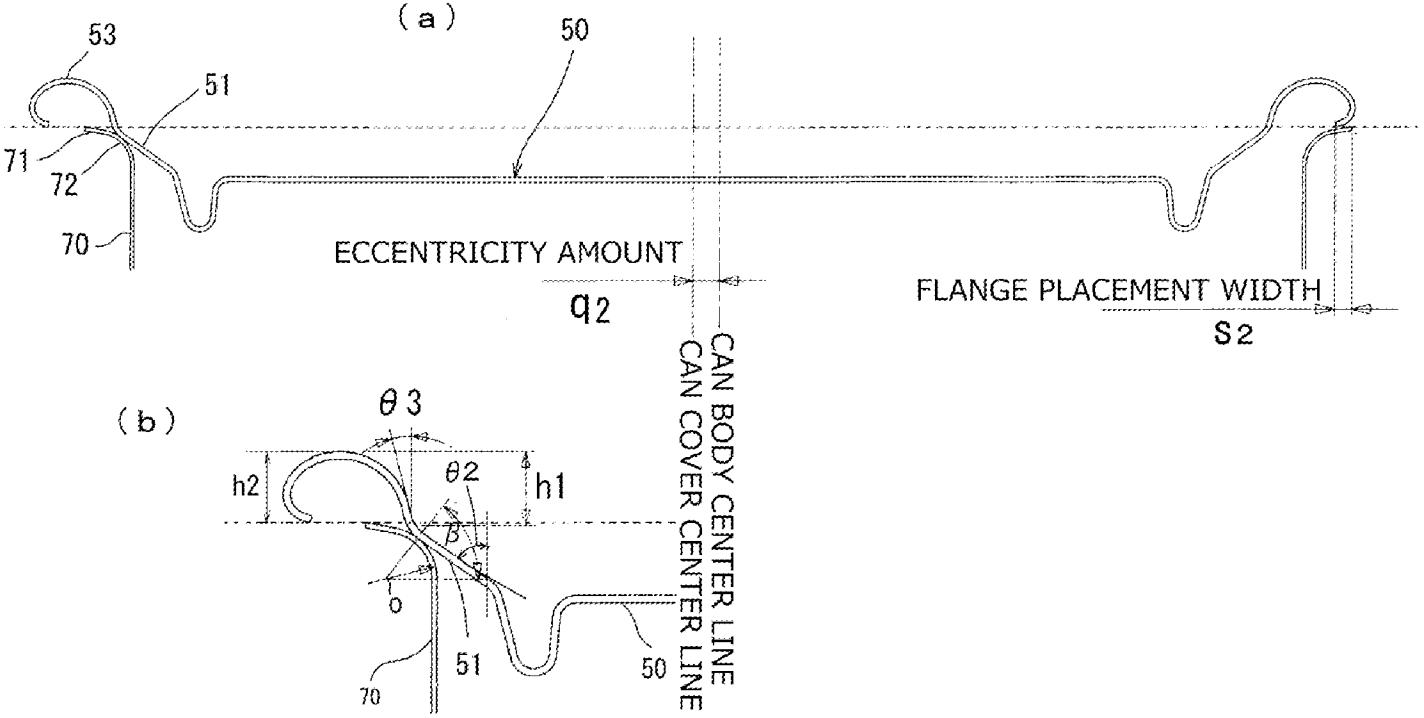
FIG. 6(*a*) is a cross-sectional view showing a state where the top of the flange of the can body and the top of the curled portion of the can cover overlap the imaginary horizontal plane on which the top of the flange is positioned when the lightweight pressure-resistant can cover applied to Comparative Example is seamed with the can body, and FIG. 6(*b*) is an enlarged view of the principal portion thereof.
Figure 8:
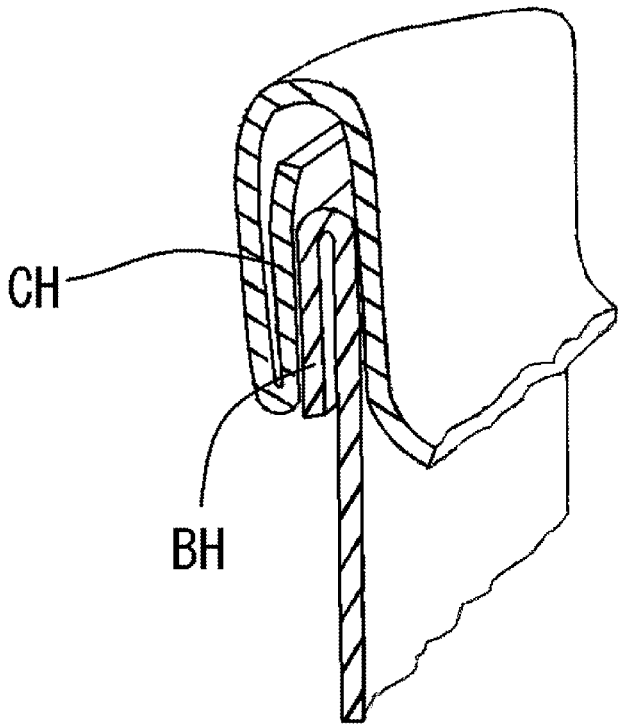
FIG. 8 is a schematic view showing the section of a seamed portion illustrating a false seam state.

However, in the conventional lightweight pressure-resistant can cover 50 in FIG. 6 as proposed in Patent document 1, in the can cover shift section described above, there are cases where the center positions of the can cover 50 and the can body 70 are displaced from each other, and a chuck wall 51 of the can cover 50 is brought into contact with an R portion 72 of a flange 71 of the can body 70 at the upper position of the R portion 72 thereof. Specifically, as enlarged and shown in FIG. 6(*b*), the chuck wall 51 is in contact with the R portion 72 at a position at an angle β=about 51.7° with respect to an imaginary horizontal plane passing through a curve center o of the R portion 72 of the flange 71, an eccentricity amount q2 of the can cover 50 with respect to the can body 70 becomes large, and a flange placement width s2 is increased. As a result, as shown in FIG. 8, the flange of the can body is not seamed with the curled portion of the can cover normally, and a seam failure called a false seam in which a curled hook CH is crushed on a body hook BH tends to occur.

Although the adjustment of the inner guide rail 31 and the outer guide rail 32 is conventionally performed in order to reduce the eccentricity amount, a problem arises in that the setting operation of the guide rail is delicate so that it is difficult to improve accuracy, and the adjustment is required every time the type of the can cover is changed, which leads to a reduction in productivity, as described above.

To cope with this, the present invention facilitates the setting operation of the guide rail, allows seaming using the lightweight pressure-resistant can cover and, even when the lightweight pressure-resistant can cover is used, reduces the displacement of the center position of the can cover with respect to the center position of the can body to thereby reduce the eccentricity amount in the can cover shift section to the can body before the intake center p where the attachment of the can cover is performed, and allows the seaming without causing the seam failure and without impairing productivity by properly performing centering or the attachment of the can cover to the can body.

That is, the present invention is a method for seaming a can cover comprised of a center panel, an annular reinforcing groove, a chuck wall, and a curled portion, and having the small-diameter center panel which satisfies a ratio between a center panel diameter and a can cover diameter of 0.65 to 0.75, wherein the chuck wall includes a first inclined portion and a second inclined portion which are outwardly inclined, and a lower end portion of the second inclined portion or a second curved portion which connects the first inclined portion and the second inclined portion is positioned at a position in a range of an angle from 0° to 35° with respect to an imaginary horizontal plane passing through a curve center of an R portion of a flange when a top of the flange of a can body and a top of the curled portion of the can cover overlap one another on an imaginary horizontal plane, whereby, even when the center positions of the can cover and the can body are displaced from each other in the can cover shift section, it is made possible to reduce the displacement of the center position to thereby reduce the eccentricity amount.

Hereinbelow, the embodiment of the present invention is described in detail based on the drawings.

FIG. 1 is a cross-sectional view of a lightweight pressure-resistant can cover (hereinafter simply referred to as a can cover) applied to the method for seaming the can cover according to the present invention.

A can cover 1 shown in FIG. 1 which is suitably applied to the present invention is formed of an aluminum alloy having a thickness of 0.20 to 0.25 mm, and has a can cover diameter D1 of 55 mm to 65 mm. The can cover 1 is comprised of a center panel 2, an annular reinforcing groove 3, a chuck wall 4, and a curled portion 5. An outer wall 6 of the annular reinforcing groove 3 rises at an inclination angle θ1 of 0° to 15° with respect to a vertical axis, extends vertically or is inclined outwardly, and is connected to a first inclined portion 4*b* of the chuck wall 4 described later via a first curved portion 4*a* having a curvature radius r1. The chuck wall 4 is comprised of the first inclined portion 4*b* which is extended from the annular reinforcing groove 3 and is inclined outwardly at an inclination angle θ2 of 50° to 70°, and a second inclined portion 4*d* which rises from the upper end of a second curved portion 4*c* at an inclination angle θ3 of 0° to 20° via a second curved portion 4*c* having a curvature radius r2, and extends vertically or is sharply inclined outwardly. The second inclined portion 4*d* is coupled to the curled portion 5. The entire chuck wall 4 is gradually inclined, the first inclined portion 4*b* and the second inclined portion 4*d* are connected by the second curved portion 4*c*, and a vertical height h1 from the lower end of the second inclined portion 4*d* to the top surface of the curled portion 5 is from 2.5 mm to 4.5 mm. As a result, as described later, in the can cover shift section, the can cover is in contact with the flange 71 of the can body 70 at an extremely low position of the second inclined portion 4*d*, it becomes possible to reduce the displacement of the center position of the can cover 1 with respect to the center position of the can body 70 to thereby reduce the eccentricity amount, and it is possible to prevent the occurrence of the seam failure such as the false seam or the like. In the can cover 1, the lower end of the first inclined portion 4*b* of the chuck wall 4 is extended to the outer wall 6 of the annular reinforcing groove 3 via the first curved portion 4*a*, and the can cover 1 is a lightweight pressure-resistant can cover having the ratio between a diameter D2 of the center panel 2 and the can cover diameter D1 of 0.65 to 0.75. Note that D3 in the drawing denotes a curl end diameter.

Figure 2:
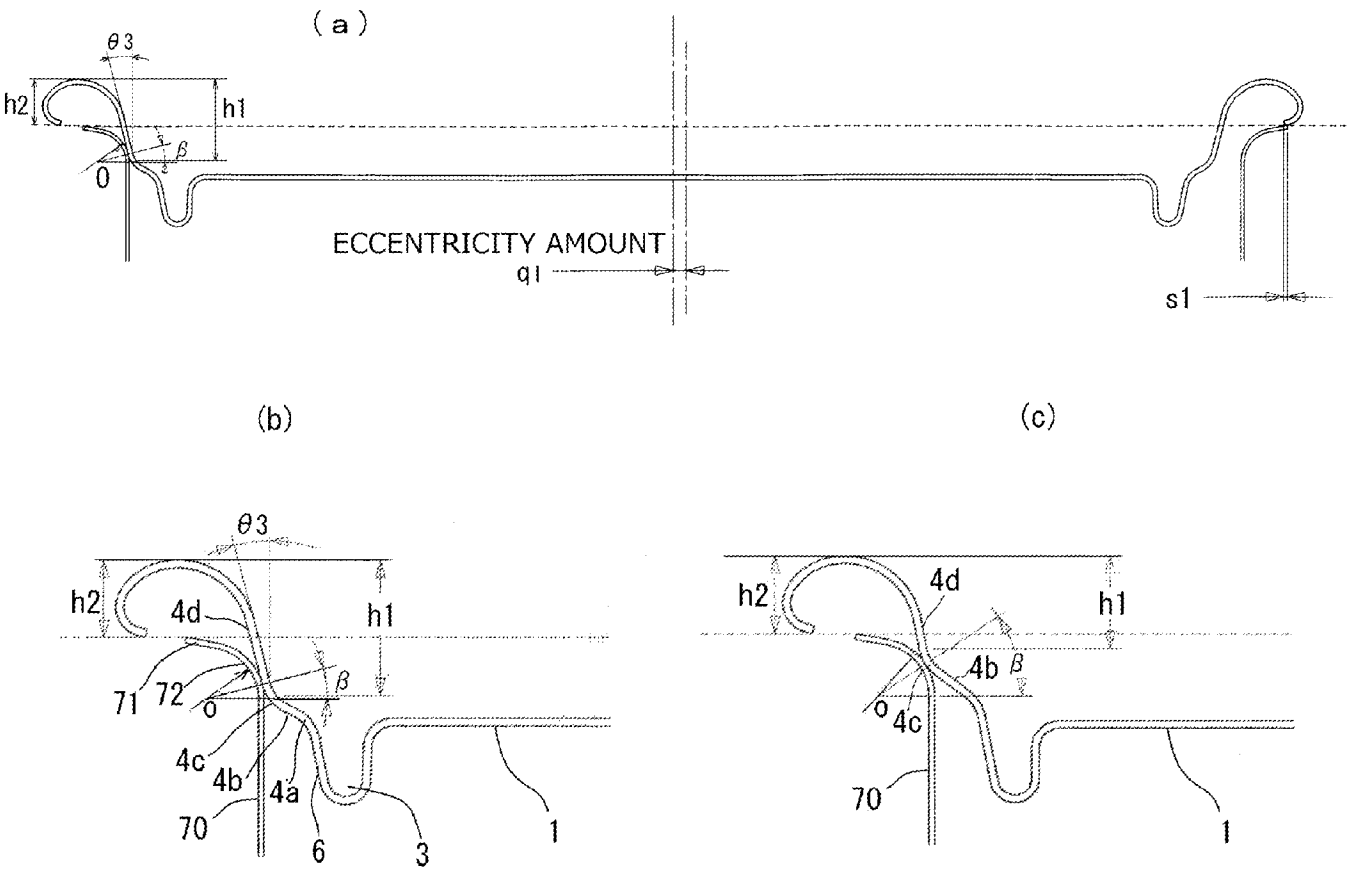
FIG. 2(*a*) is a cross-sectional view showing a state where the top of a flange of a can body and the top of a curled portion of a can cover overlap an imaginary horizontal plane on which the top of the flange is positioned, FIG. 2(*b*) is an enlarged view of the principal portion thereof, and FIG. 2(*c*) is an enlarged view of a principal portion in another Example.

FIG. 2 shows the state of contact between the can cover and the can body when the center positions thereof are displaced from each other in the can cover shift section in the present invention, FIG. 2(*a*) is an enlarged view of the principal portion thereof, and each of FIGS. 2(*b*) and 2(*c*) is an enlarged cross-sectional view of the side of the contact between the can cover and the can body.

In the can cover shift section before the intake center p in which the can body 70 is placed on the lifter plate 30 and the can cover 1 is attached to the can body 70, when the top of the flange 71 of the can body 70 and the top of the curled portion 5 of the can cover 1 overlap one another on the imaginary horizontal plane (a position at the intake a of about 3°), the lower end portion of the second inclined portion 4*d* of the chuck wall 4 is positioned at the position in a range which satisfies an angle β from the imaginary horizontal plane passing through the curve center of the R portion 72 in the flange 71 of the can body 70=0° to 35° as shown in FIG. 2(*b*), or the second curved portion 4*c* which connects the first inclined portion 4*b* and the second inclined portion 4*d* of the chuck wall 4 of the can cover 1 is positioned thereat as shown in FIG. 2(*c*). With the positioning mentioned above, in the can cover shift section, even when the center positions of the can cover 1 and the can body 70 are displaced from each other, it is made possible to reduce the displacement to thereby reduce the eccentricity amount, and properly perform centering or the attachment of the can cover 1 to the can body 70.

When the angle β exceeds 35°, in the can cover shift section, the can cover 1 is brought into contact with the high position of the R portion 72 in the flange 71 of the can body 70, the displacement is not reduced when the displacement occurs so that the eccentricity amount is increased, and it is difficult to properly perform centering or the attachment of the can cover 1 to the can body 70. Accordingly, the flange 71 of the can body 70 is not seamed with the curled portion 5 of the can cover 1 normally, and the seam failure called the false seam in which the curled hook CH is crushed on the body hook BH tends to occur, and hence the angle β is preferably not more than 35°.

In addition, in the can cover 1 applied to the present invention, the vertical height h1 from the lower end of the second inclined portion 4*d* in the chuck wall 4 to the top surface of the curled portion is from 2.5 mm to 4.5 mm, particularly from 2.7 mm to 4.0 mm, and the seam failure is thereby further prevented.

EXAMPLE 1

The dimensions of the can cover were set as follows.

the aluminum metal plate (thickness)=0.220 mm the can cover diameter D1=62.2 mm the curled portion inner diameter D3=60.4 mm the vertical height h1 from the upper end of the second curved portion 4*c* to the top of the curled portion 5=3.60 mm the inclination angle θ1 of the outer wall 6 of the annular reinforcing groove 3 with respect to the vertical axis=14.5° the inclination angle θ2 of the first inclined portion 4*b*=63.7° the inclination angle θ3 of the second inclined portion 4*d*=14.5° the center panel diameter D2=46.15 mm the curled portion height h2=2.25 mm the intake angle α of the can cover shift section=3°

The can cover was seamed with the can body having a flange width of 2.3 mm and a flange diameter of 59.5 mm.

As a result, in the can cover shift section, the positional relationship between the chuck wall of the can cover and the flange of the can body at the timing when the top of the flange of the can body and the top of the curled portion of the can cover overlapped the imaginary horizontal plane on which the top of the flange was positioned was in the state shown in each of FIGS. 2(*a*) and 2(*b*), and the angle β from the imaginary horizontal plane passing through the curve center of the R portion of the flange was 14.5° in the positional relationship between the lower end portion of the second inclined portion of the chuck wall and the flange of the can body. The displacement of the center position of the can cover with respect to the center position of the can body was reduced, the eccentricity amount q1 was 0.64 mm, and the placement width s1 of the flange of the can body on the top of the curled portion of the can cover was 0.19 mm.

EXAMPLE 2

The dimensions of the can cover were set as follows. Note that the dimensions of the can cover and the conditions other than those shown below are the same as those of Example 1.

the vertical height h1 from the upper end of the second curved portion 4*c* to the top of the curled portion 5=2.70 mm the inclination angle θ1 of the outer wall 6 of the annular reinforcing groove 3 with respect to the vertical axis=11.3° the inclination angle θ2 of the first inclined portion 4*b*=52.7° the inclination angle θ3 of the second inclined portion 4*d*=11.0°

Similarly to Example 1, the can cover was seamed with the can body.

As a result, in the can cover shift section, the positional relationship between the chuck wall of the can cover and the flange of the can body was in the state shown in FIG. 2(*c*), and the angle β from the imaginary horizontal plane passing through the curve center of the R portion of the flange was 33.5° in the positional relationship between the second curved portion which connects the first inclined portion and the second inclined portion of the chuck wall and the flange of the can body. In addition, similarly to Example 1, the displacement of the center position of the can cover with respect to the center position of the can body was reduced, the eccentricity amount q1 was 0.73 mm, and the placement width s1 of the flange of the can body on the top of the curled portion of the can cover was 0.28 mm.

Consequently, according to Examples 1 and 2 described above, when the lightweight pressure-resistant can cover was seamed with the can body, in the can cover shift section in which the supply of the can cover to the can body was carried out, it was observed that the displacement of center position of the can cover with respect to the center position of the can body was reduced so that the eccentricity amount was reduced, centering or the attachment of the can cover to the can body was properly performed, it became possible to perform seaming even when the displacement occurred, and Examples 1 and 2 were remarkably effective in seaming the lightweight pressure-resistant can cover.

COMPARATIVE EXAMPLE

As Comparative Example, the conventional can cover shown in FIG. 6 was seamed with the same can body as that in each of Examples described above.

The dimensions of the can cover of Comparative Example were as follows.

the aluminum metal plate (thickness)=0.220 mm the can cover diameter D1=62.2 mm the curled portion inner diameter D3=60.4 mm the height h1 from the upper end of the chuck wall to the top surface of the curled portion=2.05 mm the inclination angle θ2 of the chuck wall=51.7° the center panel diameter D2=43.60 mm the curled portion height h2=2.25 mm the intake angle α of the can cover shift section=3°

As a result, in the can cover shift section, the positional relationship between the chuck wall of the can cover and the flange of the can body was in the state shown in FIG. 6, and the chuck wall had the angle β from the imaginary horizontal plane passing through the curve center of the R portion of the flange of the can body was 51.7°. The displacement of the center position of the can cover with respect to the center position of the can body was large, the eccentricity amount q2 was 1.24 mm, and the placement width s2 of the flange of the can body on the top of the curled portion of the can cover was 0.79 mm.

This means that, when the can cover is seamed with the can body, in the can cover shift section in which the supply of the can cover to the can body is carried out, the displacement of the center position of the can cover with respect to the center position of the can body cannot be reduced so that it is difficult to reduce the eccentricity amount, centering or the attachment of the can cover to the can body is not properly performed, and the seam failure such as the false seam or the like may occur when the displacement occurs.

Figure 7:
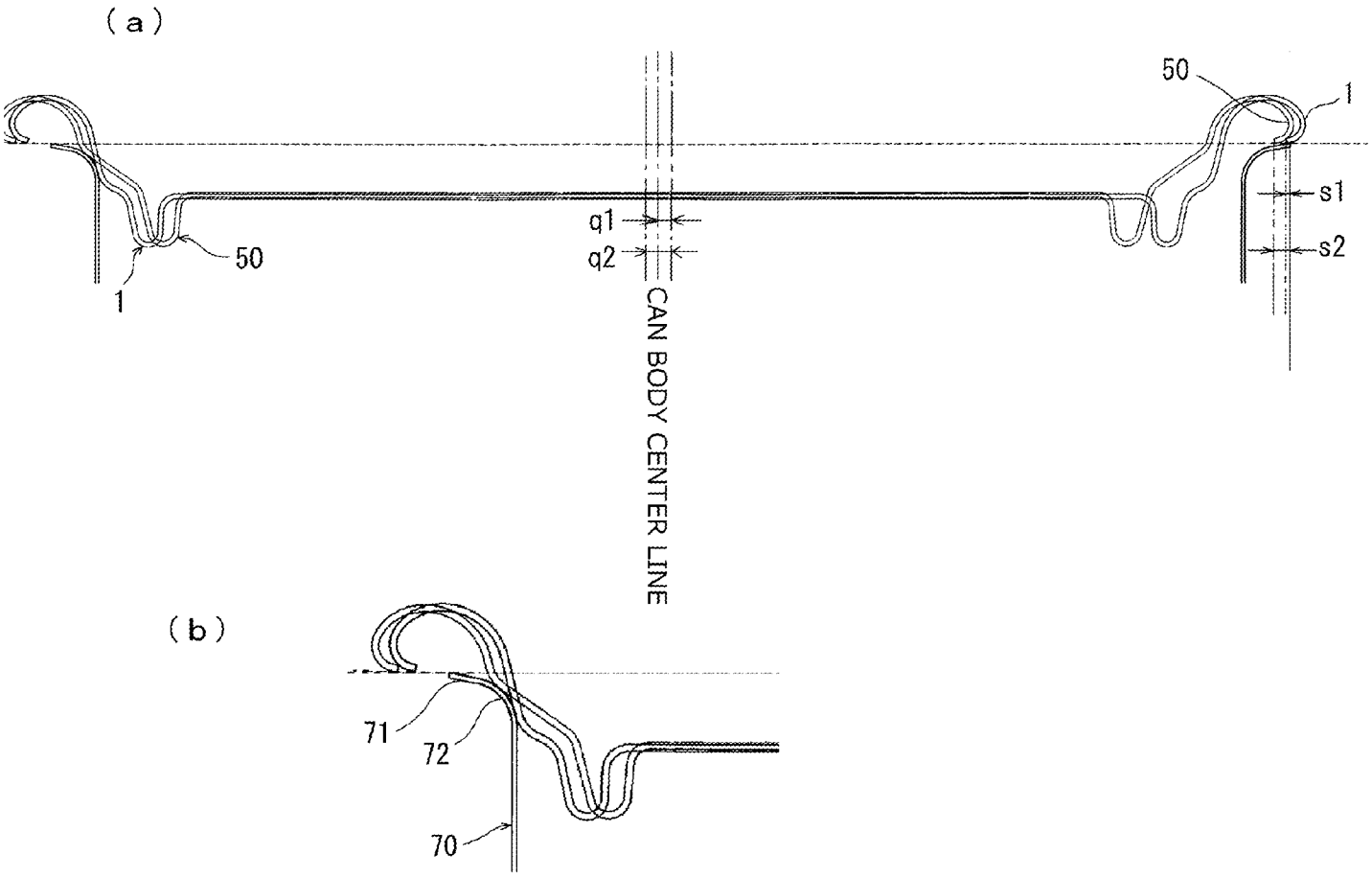
FIG. 7(*a*) is a reference view in which Example shown in FIG. 2 and Comparative Example shown in FIG. 6 are superimposed on each other, and FIG. 7(*b*) is an enlarged view of the principal portion thereof.

Note that FIG. 7 is a cross-sectional view in which Example 1 shown in FIG. 2(*b*) and Comparative Example shown in FIG. 6 are superimposed on each other.

INDUSTRIAL APPLICABILITY

According to the seaming method of the present invention, when the lightweight pressure-resistant can cover having a small center panel diameter is seamed with the can body, it is possible to reduce the displacement of the center position of the can cover with respect to the center position of the can body to thereby reduce the eccentricity amount. Particularly, by using the seaming method of the present invention as the method for seaming a positive pressure can of beer or a carbonated beverage, excellent seaming is performed without impairing productivity, and its industrial applicability is high.

The invention claimed is:

1. A method for improving the positional relationship of a can cover and a can body for seaming a can, comprising:

providing a substantially cylindrical can body having a generally r-shape flange extending outwardly and curving downwardly around a top of the substantially cylindrical can body;

providing a can cover having a substantially circular center panel, a generally u-shape annular reinforcing groove extending downwardly around the periphery of the center panel, a chuck wall extending upwardly and outwardly around the periphery of said reinforcing groove, and a curled portion extending outwardly and downwardly around the periphery of the chuck wall, including providing a ratio between a diameter of said center panel and a diameter of said entire can cover as between about 0.65 to 0.75 and providing said chuck wall with a first curved portion extending outwardly and curving downwardly from the periphery of the u-shape annular reinforcing groove, a first inclined portion extending upwardly and outwardly from a top of the first curved portion, a second curved portion extending outwardly and curving upwardly from a top of the first inclined portion, and a second inclined portion extending upwardly and outwardly from a top of the second curved portion;

positioning the can cover and the can body relative to one another with the can cover aligned above the can body;

bringing the can cover and the can body into contact with one another such that a lower end portion of the second inclined portion of the chuck wall or the second curved portion of the chuck wall contacts said can body at a point of contact at said r-shape flange such that a line extending from a center of curvature of said r-shape flange to said point of contact with respect to a horizontal plane passing through said center of curvature of said r-shape flange is at an angle within a range of between about 0° to 35° , whereby improving positional relationship between the can cover and the can body.

2. method for improving the positional relationship of a can cover and a can body for seaming a can of claim 1, further including having a maximum value of an eccentricity between the can cover and the can body as less than 0.8 mm.

3. The method for improving the positional relationship of a can cover and a can body for seaming a can of claim 2, further including providing an outer inclination angle (θ1) of an outer wall of the annular reinforcing groove with respect to a vertical axis between 0° to 15° , an inclination angle (θ2) of the first inclined portion of the chuck wall between 50° to 70° , an inclination angle (θ3) of the second inclined portion between 0° to 20° , and a vertical height (h1) from a lower end of the second inclined portion to a top surface of the curled portion between 2.5 mm to 4.5 mm.

4. The method for improving the positional relationship of a can cover and a can body for seaming a can of claim 1, further including providing an outer inclination angle (θ1) of an outer wall of the annular reinforcing groove with respect to a vertical axis between 0° to 15° , an inclination angle (θ2) of the first inclined portion of the chuck wall between 50° to 70° , an inclination angle (θ3) of the second inclined portion between 0° to 20° , and a vertical height (h1) from a lower end of the second inclined portion to a top surface of the curled portion between 2.5 mm to 4.5 mm.

5. The method for improving the positional relationship of a can cover and a can body for seaming a can of claim 1, wherein a vertical height (h1) from a lower end of the second inclined portion to a top surface of the curled portion is substantially larger than a vertical height (h2) of the curled portion.

* * * * *